US006464078B1

(12) United States Patent
Grossnickle

(10) Patent No.: US 6,464,078 B1
(45) Date of Patent: Oct. 15, 2002

(54) ARTICLE CONTAINER WITH MULTIPURPOSE OUTER CHAMBER

(76) Inventor: Reid A. Grossnickle, 660 Dahlia St., Denver, CO (US) 80220

( * ) Notice: Subject to any disclaimer, the term of this patent is extended or adjusted under 35 U.S.C. 154(b) by 0 days.

(21) Appl. No.: 09/636,773

(22) Filed: Aug. 8, 2000

(51) Int. Cl.[7] ..... B65D 83/00

(52) U.S. Cl. ..... 206/459.5; 40/324; 206/214; 206/338; 206/350; 206/457; 206/818; 221/212

(58) Field of Search ..... 206/338, 350, 206/457, 818, 214, 217, 459.5; 221/212; 428/13; 40/722, 324, 360; 215/12.1, 13.1; 220/62.14

(56) References Cited

U.S. PATENT DOCUMENTS 3,776,413 A * 12/1973 Myers ..... 220/62.14
4,058,209 A * 11/1977 Schmidt ..... 206/350
4,817,311 A * 4/1989 Ong ..... 428/13
4,928,412 A * 5/1990 Nishiyama ..... 40/324
4,941,590 A * 7/1990 Pantaleo ..... 206/217
4,979,325 A * 12/1990 White ..... 40/722
D323,352 S * 1/1992 Halm ..... D19/75
5,894,948 A * 4/1999 Yeh ..... 215/12.1
6,155,411 A * 12/2000 Ho ..... 206/457
6,216,856 B1 * 4/2001 Park ..... 206/214
6,253,918 B1 * 7/2001 Greiner ..... 206/457

OTHER PUBLICATIONS

Catalog 2000, "Double Exposure", asi/50705, cover page, pp. 16–19, back page.

* cited by examiner

*Primary Examiner*—Jim Foster
(74) *Attorney, Agent, or Firm*—Sheridan Ross P.C.

(57) ABSTRACT

A container for small articles, such as paper clips, toothpicks, pencils, pens and the like, is provided which has a multipurpose outer chamber. The outer chamber is transparent and holds indicia which may take one of two forms. In a first embodiment, the outer chamber can be filled with a transparent liquid, such as water or oil, containing indicia in the form of particles, such as glitter. Upon shaking the container, the particles temporarily become suspended in the liquid providing an interesting visual effect. In a second embodiment, the indicia may be an advertising message which includes words and/or logos printed on a sheet that surrounds a receptacle for containing the small articles that is located within the outer chamber. In a third embodiment, both the sheet bearing indicia and the glitter in a liquid can be used.

4 Claims, 1 Drawing Sheet

ARTICLE CONTAINER WITH MULTIPURPOSE OUTER CHAMBER

TECHNICAL FIELD

This invention relates to a container for small articles, such as paper clips, toothpicks, pencils, pens and the like, and particularly to a container having a transparent multipurpose outer chamber for holding selected indicia or decorative items.

BACKGROUND ART

A common but very handy desktop container for receiving and dispensing paper clips includes a receptacle for the paper clips which has a top with a central opening surrounded by an annular magnet which attracts the paper clips as they are placed into the container or removed therefrom. The magnet assures that one or more paper clips are extending through the opening in the top of the container for easy use. This paper clip container is suitable for its intended purpose.

Individuals and companies promote their products and services by the use of various advertising mediums. One common method of advertising is through the use of paper weights which carry an advertising message and/or decorative or attention-getting devices. These typically take the form of transparent glass or plastic cubes or globes. The cubes or globes typically are mounted on a wooden or plastic base which may or may not include advertising indicia. The cubes and globes usually are filled with a transparent liquid, such as water or oil. An advertising message or logo can be placed on the surface of the cubes and globes or can be placed within them. Further indicia, in the form of brightly colored particles of glitter can be placed in the liquid within the cubes and globes. By shaking the cubes or globes, the particles become temporarily suspended in the liquid and attract attention to the advertising message or logo on or within the cubes and globes. While such cubes and globes are satisfactory for their intended purpose, they have no utilitarian purpose other than serving as a paper weight.

DISCLOSURE OF THE INVENTION

This invention is directed to a container for small articles, such as paper clips, which has a multipurpose outer chamber. The outer chamber is transparent and holds indicia which may take one of two forms. In a first embodiment, the outer chamber can be filled with a transparent liquid, such as water or oil, containing indicia in the form of particles, such as glitter. Upon shaking the container, the particles temporarily become suspended in the liquid providing an interesting visual effect. In a second embodiment, the indicia may be an advertising message which includes words and/or logos printed on a sheet that surrounds a receptacle for containing the small articles that is located within the outer chamber. In a third embodiment, both the sheet bearing indicia and the glitter in a liquid can be used.

BEST MODE CARRYING OUT THE INVENTION

Figure 1:
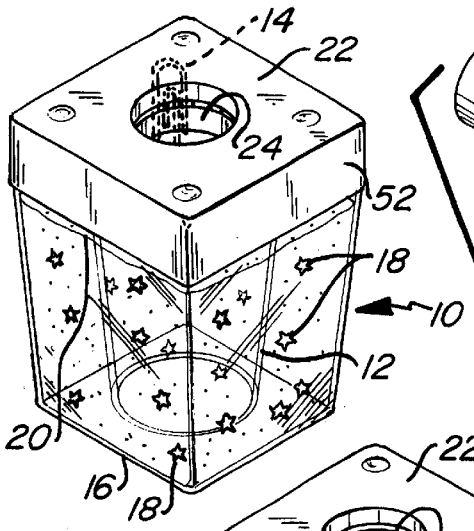
FIG. 1 is perspective view of a first embodiment of this invention.

The first embodiment of article container 10 is shown in FIG. 1. The container includes a receptacle 12 for receiving small articles, such as paper clips 14. Receptacle 12 can be either transparent or opaque but is preferably transparent for the reasons set forth below. Container 10 includes a transparent outer chamber 16 which forms a reservoir or space between it and receptacle 12. Indicia in the form of glitter 18 is provided in a transparent liquid medium 20, such as water or oil. The preferred medium is a viscous substance, such as oil. In this regard, it is important that whatever liquid is used it is such that glitter 18 can be temporarily suspended therein when the container is shaken so that glitter 18 surrounds receptacle 12. A top cover 22 forms a seal between the upper ends of receptacle 12 an outer chamber 20, respectively, as discussed more fully below. Cover 22 has an annular central opening 24 through which paper clips 14 are received and dispensed. An additional advantage is that the liquid medium 20 adds weight to the container so that it can serve an additional function as a paper weight. Furthermore, the weight of liquid medium 20 adds stability to the container so that it is less likely to tip over.

Figure 2:
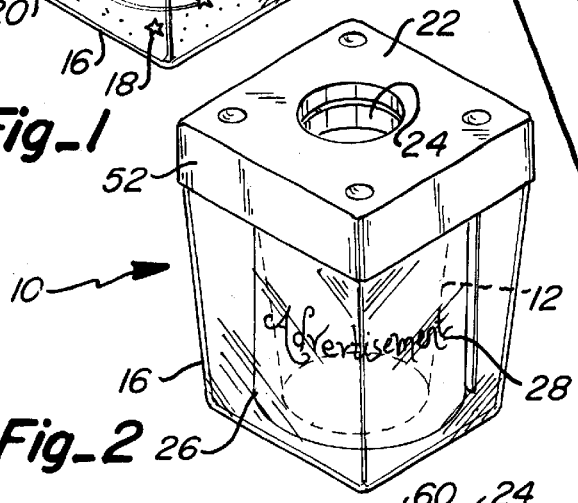
FIG. 2 is a perspective view of a second embodiment of this invention.

The second embodiment of article container 10 is shown in FIG. 2 wherein a sheet 26 bearing indicia 28 which may include advertising in the form of words and/or a logo. In this embodiment the liquid medium 20 and the indicia in the form of glitter 18 is omitted.

A third embodiment can include the glitter 18 and the liquid medium 20 of FIG. 1 and the sheet 26 of FIG. 2. In this case, sheet 26 must be made of a material, such as plastic, which will not deteriorate by being immersed in liquid medium 20. Also, it is contemplated that advertising indicia can be placed directly on the outer surface of outer chamber 16.

Figure 3:
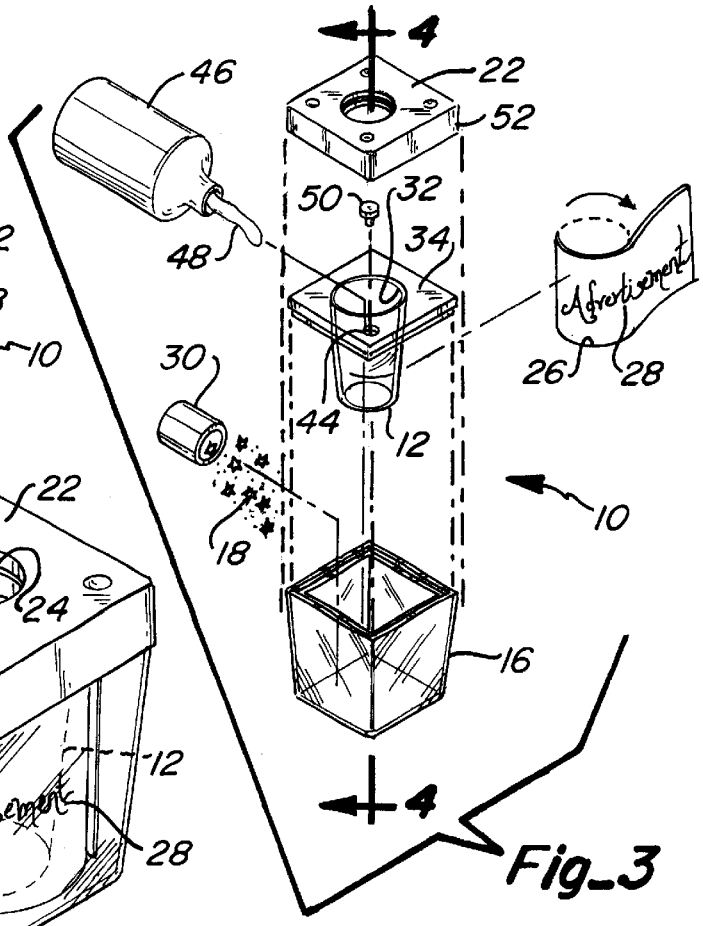
FIG. 3 is an exploded view showing the assembly of the container for both the first second embodiments.
Figure 4:
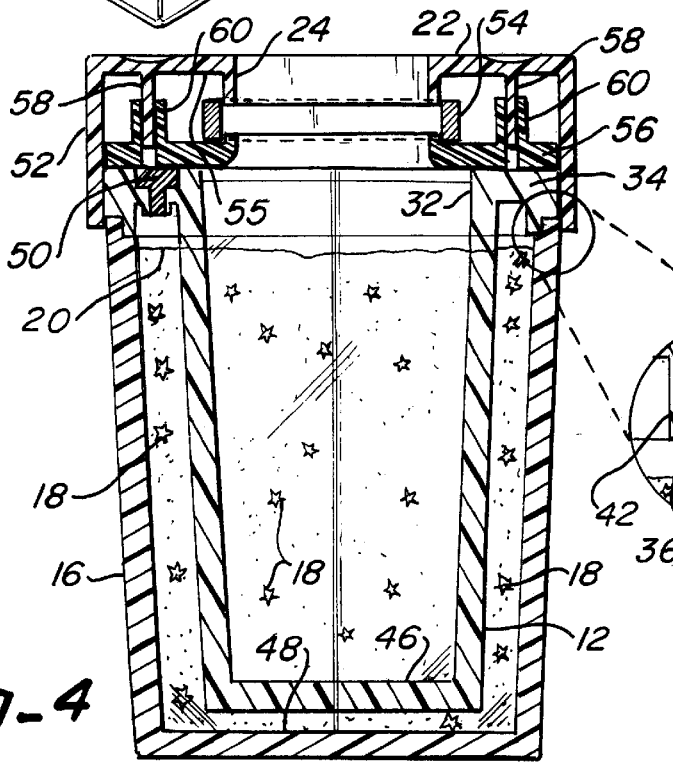
FIG. 4 is a vertical section, taken along line 4—4 of FIG. 3, showing additional details of the article container.
Figure 5:
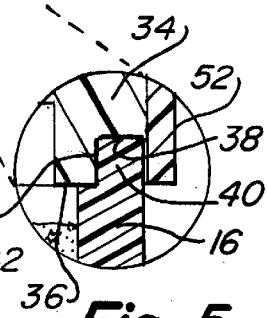
FIG. 5 is an enlarged fragmentary section of FIG. 4.

Container 10 is assembled in a matter which will be apparent by reference to FIGS. 3 and 4. First, glitter 18 is poured from glitter dispenser 30 into outer chamber 16. Next, receptacle 12, whose upper open end is centrally mounted about a circular opening 32 in square cover plate 34, is inserted into outer chamber 16, as shown in FIG. 4. The peripheral edge of cover plate 34 has a ending flange 36 with a peripheral external recess 38 which interlocks wit a peripheral lip 40 extending upwardly from side wall of receptacle 12 and has an internal recess 42 which interlock, as shown in FIG. 5. A suitable adhesive can be placed along this interconnection to assure that no leakage occurs. Conveniently, cover plate 34 is provided with a fill opening 44 for adding liquid, such as oil 20. An oil dispenser 46 can be us ed for this purpose which has a nozzle 48 that can be inserted into fill opening 44. As best seen in FIG. 4, receptacle 12 is slightly shorter than outer chamber 16 so that bottom 46 of receptacle 12 is spaced above bottom 48 of chamber 16 so that oil 20 and glitter 18 can pass therebetween. After the oil has been filled to a level slightly below cover plate 34 a plug 50 is plied in fill opening 44 to seal the oil inside the space or reservoir formed between outer chamber 16 and receptacle 12. The space between the upper level of oil 20 and cover plate 34 need only be enough to allow agitation of oil 20 when the container is shaken which is sufficient to cause the particles of glitter 18 to become temporarily suspended in the oil. This crates a pleasing visual effect to the user and will occur whenever container 10 is shaken to get access to the paper clips or when it is shaken merely to observe the visual effect created thereby. If receptacle 12 is transparent, light can pass both through receptacle 12 and outer chamber 16. When container 10 is shaken, the resulting movement of suspended glitter 18 in oil 20 causes the illusion that the paper clips are suspended within outer chamber 16 because receptacle 12 becomes substantially invisible Finally, cover 22 is planed over cover plate 34. As shown in FIG. 4, cover 22 has a depending peripheral flange 52 which extends over the peripheral edge of cover plate 34 and the upper peripheral edge of outer chamber 16 and can be attached thereto by friction or by an adhesive. An annular magnet 54 is positioned in a recess 55 below opening 24 and held in place by annular plate 56. Conveniently, cover 22 has a plurality of spaced depending pins 58 which engage corresponding upwardly extending sleeves 60 on annular plate 56 This structure positions magnet 54 so that it can attract and hold paper clips 14 when they are being placed into or retrieved from opening 24 in lid 22 of receptacle 12.

When the embodiment of FIG. 2 is made, instead of placing glitter in outer chamber 16, sheet 26, bearing indicia 28, is wrapped around the outer surface of receptacle 12 prior to placing it inside outer chamber 16. In this case, no oil is inserted through fill opening 44. The space between outer chamber 16 and receptacle 12 merely contains ambient air.

If container 10, in ant of the embodiments previously described, is to be used with articles which are as long or longer than receptacle 12 is high, cover 22 can be omitted. In this way, opening 32 is exposed, which is larger than opening 24, to more easily accommodate articles such as toothpicks, pencils, pens an, the like.

From the foregoing, the advantages of this invention are readily apparent. An article container has been provided with an outer chamber which, in addition to dispensing and receiving small articles, such as paper clips, provides the multiple function of creating a venue for displaying advertising indicia and for displaying decorative indicia, such as glitter. Thus, every time the user of the container picks it up to retrieve a paper clip, the motion, such as shaking, created in removing the paper clips causes the glitter to be temporarily suspended in the oil creating a pleasing visual effect which draws the users attention to advertising indicia on or within the outer chamber.

This invention has been described in detail with reference to particular embodiments thereof, but it will be understood that various other modifications can be effected within the spirit and scope of this invention.

What is claimed is:

1. A container for storing and/or dispensing small articles, said container comprising:

a receptacle for storing the small articles, having a side wall with an upper and lower end, a base formed at said lower end and an opening formed at said upper end through which the articles can be received and dispensed;

a transparent outer chamber surrounding said receptacle and spaced therefrom, having a base and an upper end;

indicia positioned in the space formed between said receptacle and said outer chamber;

a magnet communicating with said opening for attracting the small articles;

a cover having a recess formed in a lower surface thereof, and a cover opening for receiving said magnet; and an annular plate attached to said lower surface of said cover to capture said magnet in said recess.

2. A method of constructing a container for storing and dispensing small articles, said method comprising the steps of:

forming an outer chamber which has a base and an upper end;

placing small particles in the outer chamber;

providing a receptacle which has a base and an upper end;

attaching a cover plate, having a central circular opening and a fill opening, to the upper end of the receptacle;

placing the receptacle into the outer chamber and sealing the peripheral edge of the cover plate to the upper end of the outer chamber to provided a sealed space between the outer chamber and the receptacle so that the bottom of the receptacle is spaced above the bottom of the outer chamber;

pouring liquid into the outer chamber through the fill opening enabling the liquid to suspend at least temporarily the small particles; and closing the fill opening.

3. A method, as claimed in claim 2, including the further steps of:

placing a cover, having a central opening with a magnet surrounding the central opening, over the cover plate; and attaching the cover to the cover plate.

4. A method, as claimed in claim 2, including a further step after said step of attaching a cover plate of:

placing an advertisement around the receptacle.

* * * * *